US006699353B1

(12) United States Patent
Guillaumot et al.

(10) Patent No.: US 6,699,353 B1
(45) Date of Patent: Mar. 2, 2004

(54) USE OF AN AIR PERMEABLE PAPER SHEET AS SUPPORT ELEMENT FOR A STACK OF FABRICS

(75) Inventors: Christophe Guillaumot, Chemin des Buclos (FR); Didier Bigot, Champ Pres Froges (FR)

(73) Assignee: Ahlstrom Lystil SA, Brignoud (FR)

( * ) Notice: Subject to any disclaimer, the term of this patent is extended or adjusted under 35 U.S.C. 154(b) by 0 days.

(21) Appl. No.: 09/622,152

(22) PCT Filed: Jan. 20, 1999

(86) PCT No.: PCT/FR99/00115

§ 371 (c)(1),
(2), (4) Date: Aug. 11, 2000

(87) PCT Pub. No.: WO99/40809

PCT Pub. Date: Aug. 19, 1999

(51) Int. Cl.[7] ..... A41H 43/02; D06H 7/00

(52) U.S. Cl. ..... 156/299; 156/300; 29/559; 269/21; 198/689.1; 198/811; 83/451; 83/100; 83/152; 83/938; 428/131

(58) Field of Search ..... 83/451, 100, 152, 83/938; 478/131; 29/559; 269/21; 198/689.1, 811; 156/299, 300

(56) References Cited

U.S. PATENT DOCUMENTS

| | | | | |
|---|---|---|---|---|
| 3,495,492 A | | 2/1970 | Gerber et al. | 83/374 |
| 3,790,154 A | | 2/1974 | Gerber et al. | 269/22 |
| 3,835,747 A | | 9/1974 | Bystron | 83/422 |
| 4,455,237 A | * | 6/1984 | Kinsley | 210/767 |
| 5,699,707 A | * | 12/1997 | Campbell, Jr. | 83/100 |

FOREIGN PATENT DOCUMENTS

| | | | |
|---|---|---|---|
| EP | 0 400 249 | 12/1990 | |
| EP | 0 426 288 A2 | 5/1991 | D21F/11/14 |
| EP | 0 483 816 A1 | 5/1992 | D04H/1/44 |
| EP | 0 616 074 A1 | 9/1994 | D21F/11/00 |

* cited by examiner

*Primary Examiner*—William P. Watkins, III
(74) *Attorney, Agent, or Firm*—Heslin Rothenberg Farley & Mesiti P.C.; Mary Louise Gioeni, Esq.

(57) ABSTRACT

The invention concerns an air permeable paper sheet as support element for a layer of fabrics (mat) on a production line in particular during the cutting phase. The invention is characterized in that said sheet has in its thickness pores or fine perforations distributed over the whole surface thereof, said sheet having a bulkiness or hand more than 2.5 $cm^3/g$, enabling it to allow air to pass through by the suction effect produced from beneath its lower surface.

11 Claims, 5 Drawing Sheets

USE OF AN AIR PERMEABLE PAPER SHEET AS SUPPORT ELEMENT FOR A STACK OF FABRICS

TECHNICAL FIELD

The present invention relates to the technical sector of manufacturing and it relates more particularly to a novel type of sheet support used as an element for transporting/conveying a mat which consists of a plurality of superimposed textile layers and which is intended to be cut up into the form of elementary panels of suitable shape in order subsequently to be joined together to produce the final product, such as a garment.

PRIOR ART

In the manufacturing field, it was proposed a very long time ago, as is especially apparent from FR-A-2,194,823 (corresponding to U.S. Pat. No. 3,495,492), to produce mats from textile structures (wovens or knits) intended for producing the manufactured article, which mats are transferred onto a cutting table.

During this operation, the fabric mat is placed on an air-permeable support and the cutting into elementary panels is carried out while creating a vacuum beneath the said table, so that the stack is perfectly held down during the cutting phase.

To avoid any movement of the elementary layers one with respect to another, and as is especially apparent from the aforementioned FR document and from FR-A-2,030,792 (corresponding to U.S. Pat. No. 3,495,492), the mat is covered in its upper part by an air-impermeable plastic film, thereby making it possible to compact the said mat during the cutting phase and avoiding any movement of the elementary layers one with respect to another.

With regard to the air-permeable supports which are used for supporting and transferring the mat consisting of continuous textile webs to the cutting station, various solutions have been proposed.

Thus, in FR 2,030,792 the support consists of a layer of material into which the tool can penetrate and which has channels or passages, thereby making it possible, with the vacuum exerted beneath the stack, to exert a suction action tending to hold down the material on the support table.

At the present time, the solution most often used consists in placing relatively rigid papers beneath the stack, these being perforated by stamping or notching, which have the essential advantage of being relatively inexpensive.

One of the problems which arise with such supports, therefore having channels or orifices allowing the air to flow out, stems from the fact that the suction is not uniformly distributed over the entire surface of the mat and, in some cases, there may therefore be irregular "compaction" possibly resulting in defects in the cut panels.

In addition, the operation of forming the perforations is necessarily carried out after the manufacture of the paper and therefore results in the production of scrap.

SUMMARY OF THE INVENTION

The object of the invention is to propose the use of an air-permeable paper sheet as support element for a fabric stack on a manufacturing line, especially as support during the cutting phase. Such paper sheets are known per se, as revealed especially in Patents EP-A-616,074, EP-A-483,816 and EP-A-426,288 and have been proposed for producing articles having a great capacity for absorbing liquids, especially for the purpose of using them as wiping materials, hygiene articles, etc.

However, it has been found, and it is this which forms the subject of the invention, that it is possible to use such materials, which are inexpensive to manufacture, as support elements for a stack of fabrics (mat) on a manufacturing line, especially during the operation of cutting the said stack in order to produce elementary panels of suitable shape which are subsequently joined together to produce the final product.

It has been found, surprisingly, that the use of such a paper sheet, instead of the relatively rigid papers perforated by stamping or notching which were used in this technical field, helps to compact the stack under the action of the suction exerted during this cutting phase, ensures that the said mat slides easily on the table when placed thereon, prevents the textile structure from being marked, especially when it is a lightweight structure, and finally can be used practically for any type of textile structure.

For such an application, as paper sheet intended to serve as support, a sheet having, in its thickness, pores or fine perforations distributed over its entire surface will be used, the said sheet having a "bulk" or "body" expressed in cubic centimetres per gram of greater than 2.5, making it capable of allowing air to pass through it due to the effect of suction produced beneath its underside.

According to a first embodiment, the sheet structure has pores uniformly distributed over its entire surface, the said pores having a diameter of less than one millimetre and preferably between 50 and 150 microns.

According to a second embodiment, the pores or fine perforations are distributed in the form of patterns having a central region with high air permeability surrounded by a denser fibrous region with lower permeability.

Lastly, according to a final embodiment, the spacing between the centres of two consecutive patterns is less than 5 mm and preferably less than 3 mm, the central region with high permeability containing no fibres and having a total area of about 1 to 2 $mm^2$.

The invention also relates to a process for obtaining a paper sheet that can be used as support element for a fabric stack on a manufacturing line, which consists in producing a filter paper directly on a paper machine, without any special modification, characterized in that, when obtaining the said paper:

- during the preparation of the pulp, the cellulose fibres (wood pulp) are individualized without refining them excessively so as to maintain the maximum permeability;
- the said pulp is fed to the machine with a very low concentration of less than one gram per liter, thereby making it possible to obtain a bulking sheet; and
- the sheet produced is not compressed at the wet end of the machine so as to maintain its permeability.

Preferably, according to the invention, the permeability is maximized by subjecting the paper sheet produced, before it is dried, to a textiling treatment which consists in locally displacing the fibres by means of fluid jets or knives through a mesh having a coarse texture or through a perforated cylinder of the rotary printing cylinder type, or screen-printing type, so as to form patterns having a central region of high air permeability surrounded by a region with lower permeability.

In such a case of textiling treatment, the latter may have the consequence either of leaving in the central part only a small minority of fibres or of possibly producing a true perforation containing no fibres.

Such a treatment may be carried out on machines of known type, for example of the type forming the subject-matter in particular of FR-A-2,625,937.

Optionally, in order to improve the tear strength of the paper, it may be envisaged to incorporate synthetic or artificial fibres into the cellulose pulp, and to do so in an amount of 5 to 25%, the incorporation of such fibres moreover having a complementary effect of aerating the sheet and of consequently improving the permeability.

It has been found that an incorporation of less than 5% has no significant effect and that if this incorporation is greater than 25%, then, on the one hand, the manufacturing costs increase appreciably and, on the other hand and above all, it is absolutely essential to use additional binders.

Finally, as known in the paper field, it may be envisaged to incorporate an additional binder in an amount of about 5 to 25%, thereby making it possible to achieve chemical bonding, which improves the mechanical properties. Optionally, it could be envisaged to incorporate less than 5% of additional binders, but in this case the mechanical properties are hardly improved. Above 25%, the costs increase appreciably without any significant improvement in the properties.

As reinforcing fibres, it is possible to use synthetic fibres such as polyester, polyamide, polypropylene or polyethylene fibres, or even artificial fibres such as viscose fibres, or even natural fibres such as flax or cotton fibres for example.

The possible binders will be chosen from the following ingredients, possibly combined together:

- conventional polymers also called "LATEX", particularly of the acrylic type, ethylene-vinyl acetate type, vinyl acetate type, polyvinyl alcohol type, styrene-butadiene type, etc., and their associated copolymers by copolymerization or terpolymerization;
- starch, carboxymethylcellulose, hexamethyl-cellulose;
- polyamide or polyamine epichlorohydrin;
- heat-bonding fibres.

EMBODIMENT OF THE INVENTION

The invention and the advantages that it provides will, however, be more clearly understood by means of the illustrative examples given below by way of indication, but implying no limitation, in which examples the properties of the paper according to the invention are compared with three specimens of conventional perforated papers referred to as Sp1, Sp2, Sp3, respectively.

These examples are illustrated by the appended figures in which.

EXAMPLE 1

A paper that can be used according to the invention as a support element for a stack of fabrics on a manufacturing line, is produced from a conventional paper composition consisting of 77% unbleached southern-pine kraft pulp and 8% unbleached fluff pulp.

In the circuit, sufficient water is added in order to obtain a final dilution of less than 1 g/liter, namely, in the present case, 0.3 g/liter, allowing the fibres to be uniformly dispersed.

Binders consisting of 5% pregelatinized cationic starch and 10% vinyl acetate latex are incorporated, these binders being incorporated by any conventional technique such as a padding, spraying or imprinting or "size press" technique and, in the present case, a "size press" technique.

Figure 4:
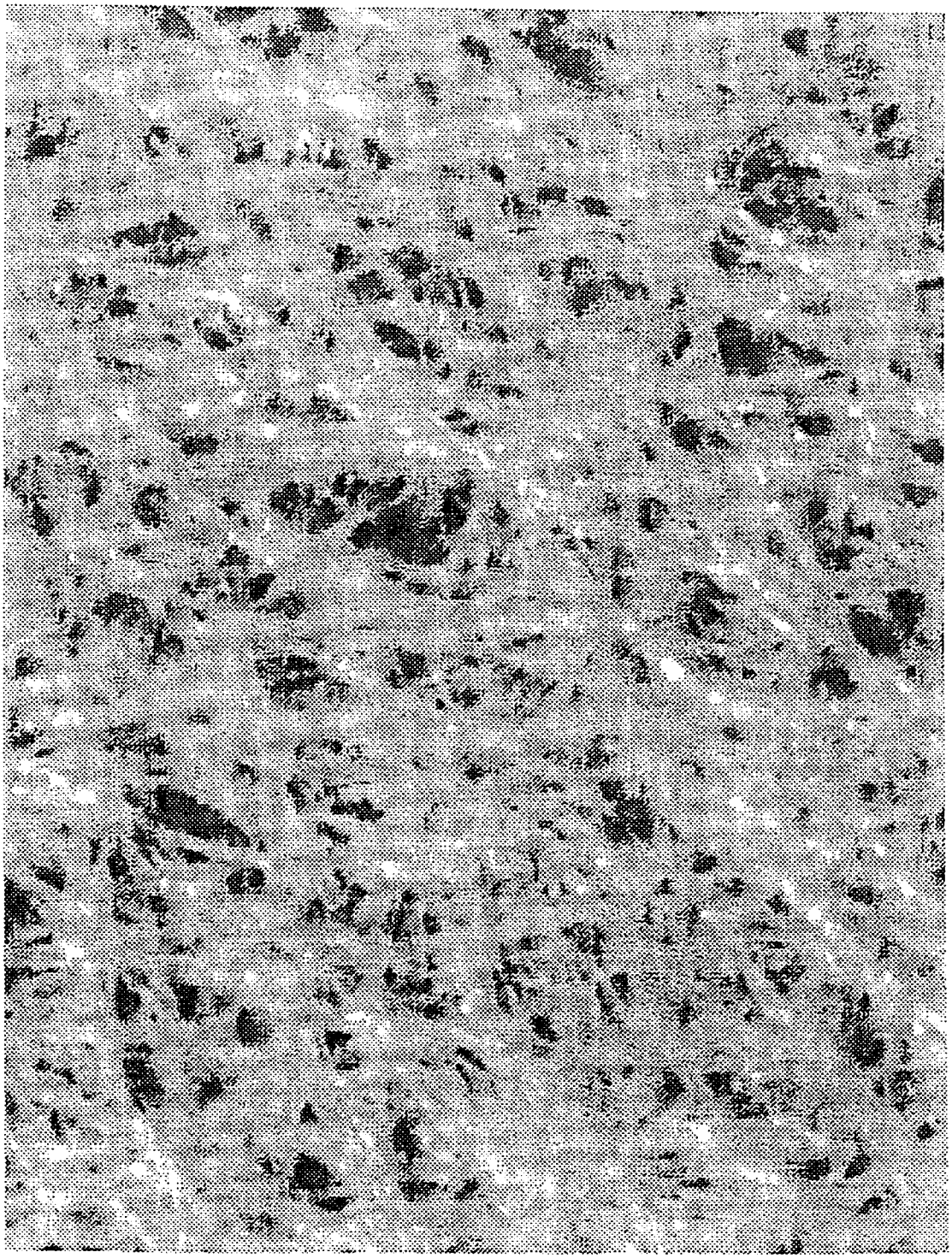
FIG. 4 is a reproduction, with a magnification of about 200, of a sheet structure in which the pores are distributed uniformly over the entire surface of the said sheet.

After drying and crosslinking, the end product is wound up with the desired width by the user and has a structure as illustrated in FIG. 4.

Figure 1:
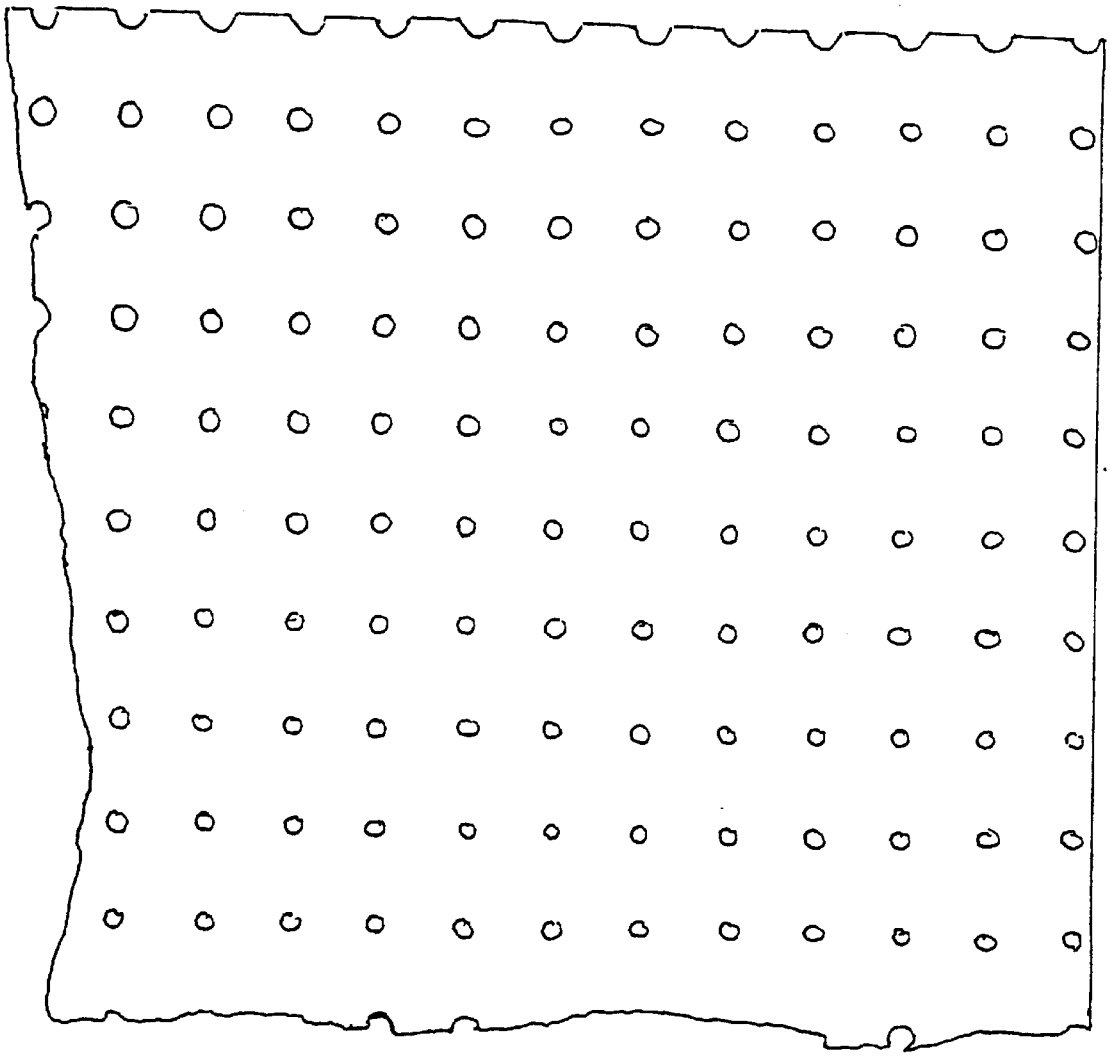
FIGS. 1, 2 and 3 are reproductions, on a scale of 1, of three conventional perforated papers.
Figure 2:
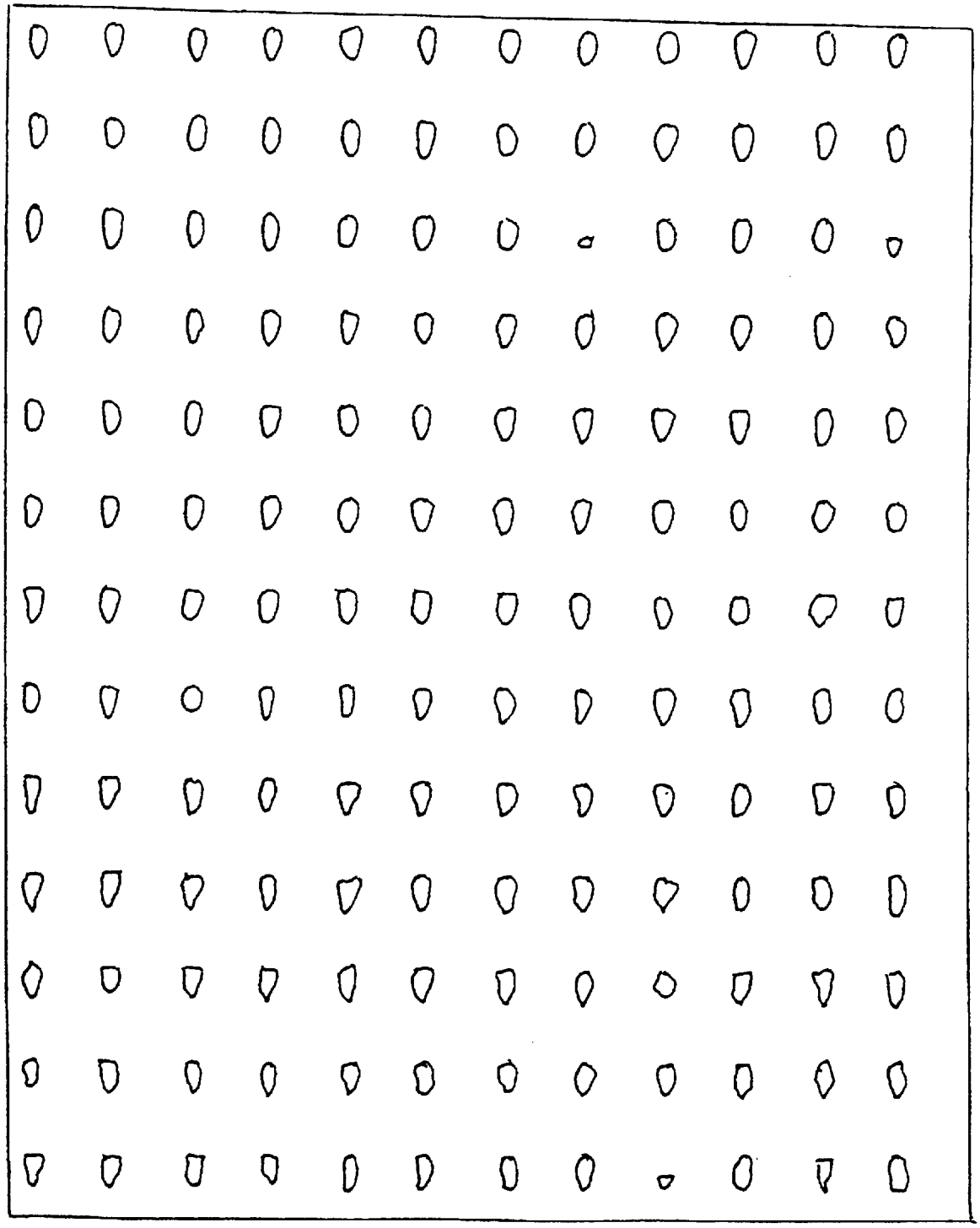
Figure 3:
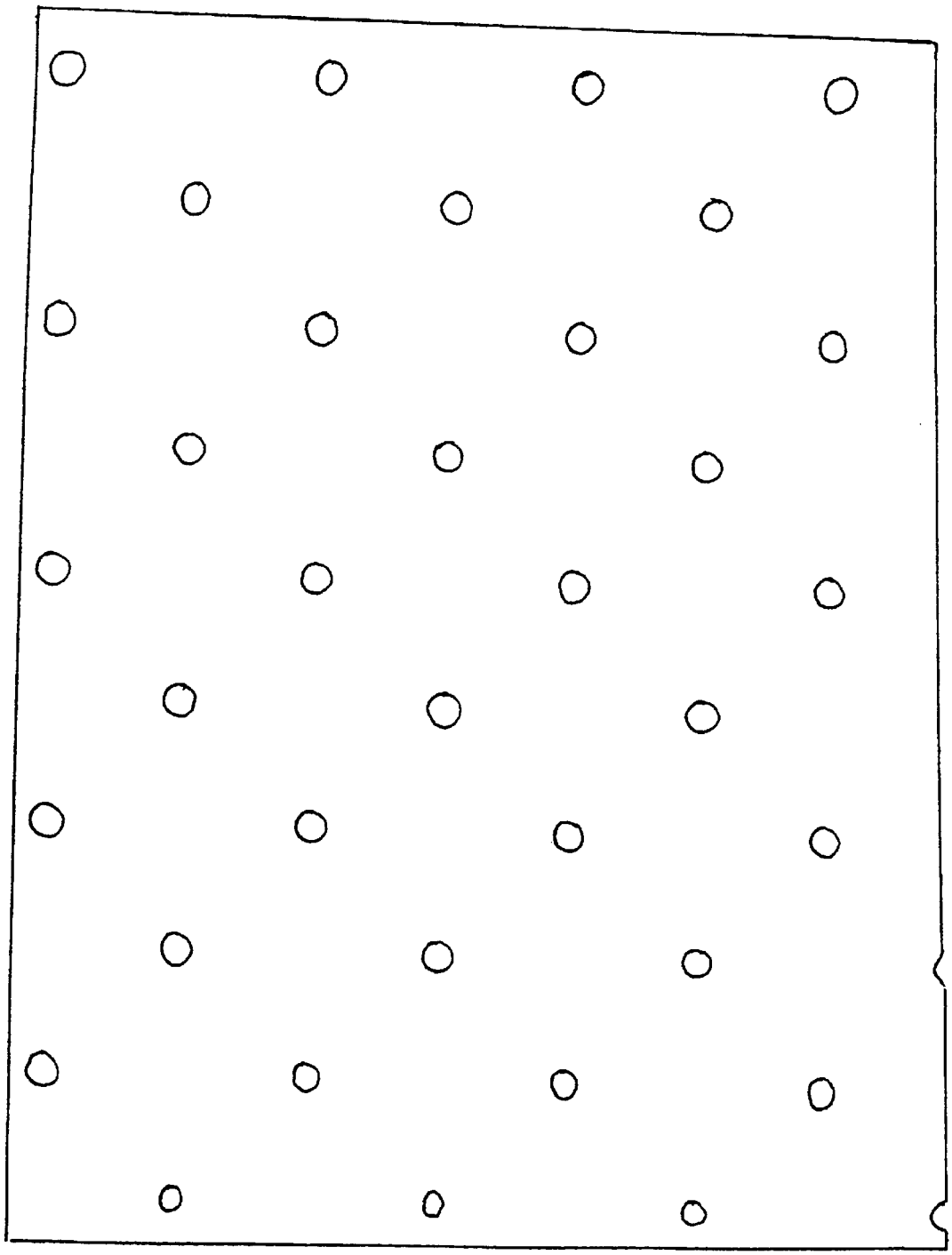

The table below gives the characteristics of such a product compared with three conventional perforated papers as illustrated in FIG. 1 (Sp1), FIG. 2 (Sp2) and FIG. 3 (Sp3).

| | | | "Perforated" papers | | |
|---|---|---|---|---|---|
| Characteristics | Units | Invention | Sp1 | Sp2 | Sp3 |
| Grammage | $g/m^2$ | 45.6 | 67 | 84 | 56 |
| Thickness | microns | 161 | 124 | 160 | 89 |
| Body | $cm^3/g$ | 3.53 | 1.85 | 1.9 | 1.59 |
| Permeability | $1/m^2/s$ under 196 Pa | 309 | 112 | 822 | 305 |
| Tensile strength, machine direction | N/m | 3252 | 3726 | 2898 | 1762 |
| Tensile strength, cross direction | N/m | 2123 | 1792 | 728 | 736 |
| Elongation, machine direction | % | 2.6 | 1.8 | 1.3 | 0.9 |
| Elongation, cross direction | % | 5.5 | 2.2 | 0.9 | 1.4 |
| Tear strength, machine direction | Cn | 187 | 198 | 185 | 100 |
| Tear strength, cross direction | Cn | 207 | 332 | 210 | 129 |
| Mean pore diameter | microns | 50 | several millimeters | | |

It has been found that during the use, as support element for a stack of fabrics on a manufacturing line, of such a paper, despite a mean permeability of 309 $1/m^2/s$—whereas in the control specimens the permeability may sometimes be markedly higher (see specimen 2)—in practice the hold-down of the textile stack on the cutting table is improved, making the cutting easier.

Such an improvement may be explained, on the one hand, by the fact that the outflow of air produced by the suction source takes place uniformly over the entire surface of the paper through the pores which are uniformly distributed over the latter and, on the other hand, that this outflow is also facilitated by the markedly higher "body" compared with the prior products.

EXAMPLE 2

A paper sheet that can be used according to the invention as support for a stack of fabrics is produced by carrying out, before adding the binder as in Example 1, a textiling treatment by passing it over a conventional machine for conventional fluid jet or knife treatment, of the type of those sold by the company ICBT Perfojet.

In order to produce such a paper, a paper pulp comprising, as in Example 1:

77% unbleached southern-pine kraft pulp; and

8% unbleached fluff pulp is used.

The entire pulp is defibred/refined to only 15 degrees Schopper-Riegler with approximately 30 g/liter of water.

As in Example 1, sufficient water is provided in the circuit in order to achieve a final dilution of less than 1 g/liter, and in the present case 0.3 g/liter, thereby ensuring that the fibres are uniformly dispersed.

The still-wet fibrous web thus formed receives a microperforation treatment by a fluid jet or knife on a conventional Perfojet-type machine, with a perforated cylinder or through a mesh with an open structure with a water pressure of 5 to 80 bar. Such a treatment makes it possible to obtain, locally, partial or total displacement of the fibres according to the pattern on the cylinder or the mesh size of the mesh. In the present case, the treatment is carried out with a 9-bar water knife.

After this operation, binders are added by any appropriate means, namely padding, spraying, imprinting or "size press", these binders being based on a composition containing 5% pregelatinized cationic starch and 10% vinyl acetate latex.

Figure 5:
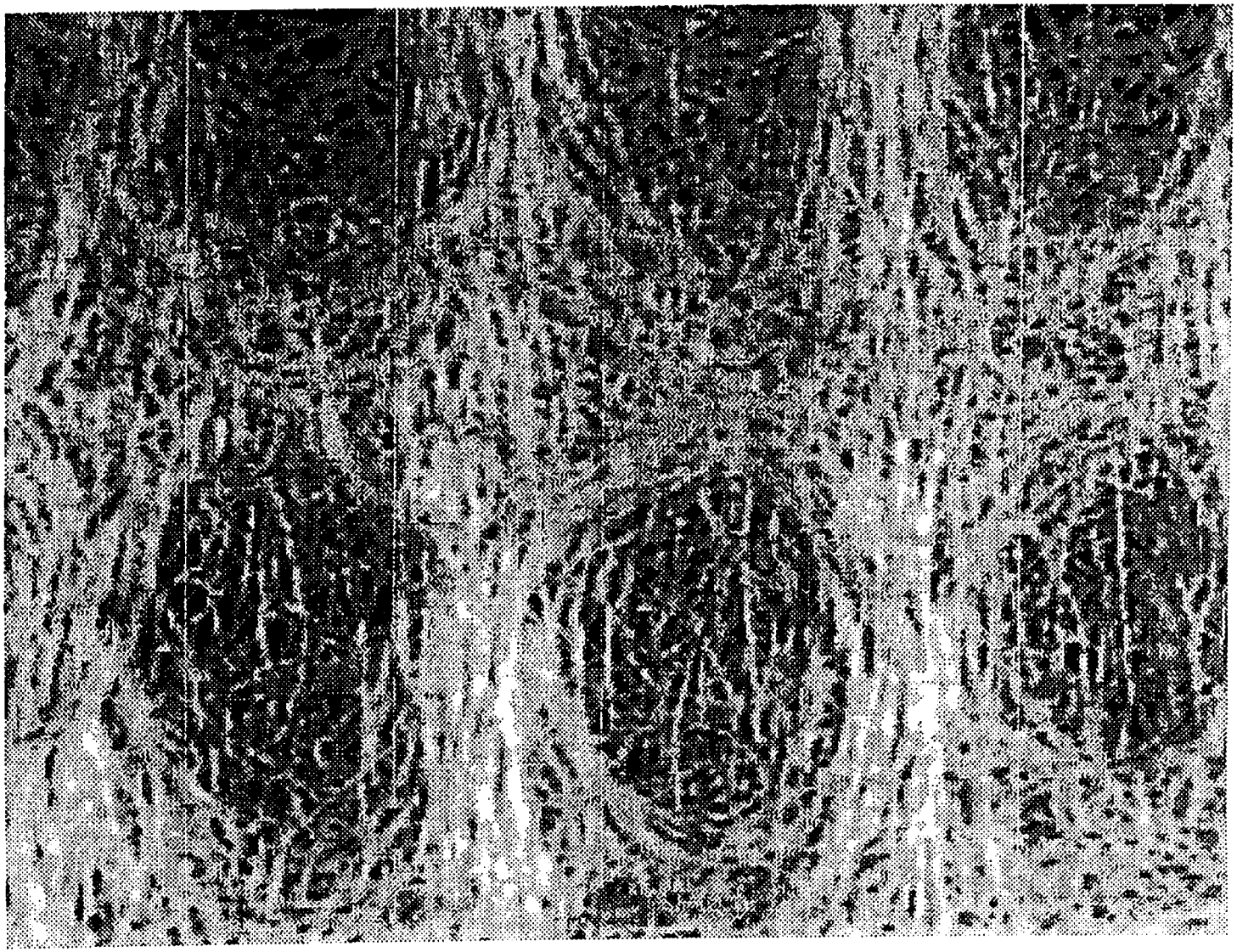
FIG. 5 is a reproduction, magnified by about 30, of a sheet structure that has received a textiling treatment which reorients the fibres.

After drying and crosslinking, the end product is wound up with the desired width for the envisaged use, having a structure as illustrated in FIG. 5.

The table below gives the characteristics of such a product compared with three conventional perforated papers.

| | | | "Perforated" papers | | |
|---|---|---|---|---|---|
| Characteristics | Units | Invention | Sp1 | Sp2 | Sp3 |
| Grammage | $g/m^2$ | 35.6 | 67 | 84 | 56 |
| Thickness | microns | 163 | 124 | 160 | 89 |
| Body | $cm^3/g$ | 4.59 | 1.85 | 1.9 | 1.59 |
| Permeability | $1/m^2/s$ under 196 Pa | 1081 | 112 | 822 | 305 |
| Tensile strength, machine direction | N/m | 1707 | 3726 | 2898 | 1762 |
| Tensile strength, cross direction | N/m | 1152 | 1792 | 728 | 736 |
| Elongation, machine direction | % | 2.5 | 1.8 | 1.3 | 0.9 |
| Elongation, cross direction | % | 6.1 | 2.2 | 0.9 | 1.4 |
| Tear strength, machine direction | Cn | 146 | 198 | 185 | 100 |
| Tear strength, cross direction | Cn | 169 | 332 | 210 | 129 |
| Mean pore diameter | microns | 150 | several millimeters | | |

Compared with Example 1, a paper is obtained which has a markedly higher permeability than the prior papers and which, compared with the product produced according to Example 1, makes it even more suitable as support for a stack of fabrics on a manufacturing line.

EXAMPLE 3

Example 2 is repeated, except that reinforcing fibres are incorporated into the paper pulp.

The aqueous composition contains 72% unbleached southern-pine kraft pulp and 9% unbleached fluff pulp.

All of the pulp is defibred/refined to only 18 degrees Schopper-Riegler and incorporated into it are 5% of 1.7 decitex polyester fibres chopped to 18 mm.

The mixing into water is done so as to have 15 to 20 g/liter approximately.

A wet-strength agent, consisting of 0.7% of a polyamide epichlorohydrin resin, is added in the circuit for feeding the forming fabric.

The supply of water to the circuit is carried out in such a way that a final dilution of less than one gram/liter is obtained, making it possible to ensure that the fibres are uniformly dispersed, which dilution in this example is 0.3 g/liter.

The wet fibrous web thus formed is textiled in a manner similar to Example 2, the fluid pressure being 11 bar and the water knife having been replaced by fluid jets, with approximately 100 jets/needles per metre of width, making it possible to obtain a structure which is similar to that in Example 2 and which is shown in FIG. 5.

After the textiling treatment, an additional binder is deposited, consisting of a composition containing 5% pregelatinized cationic starch and 10% vinyl acetate latex.

The incorporation of these ingredients and binders is also carried out in a conventional manner and, after drying/crosslinking, the end product is also wound up with the desired width.

The table below gives the characteristics of such a paper compared with the conventional perforated papers.

| | | | "Perforated" papers | | |
|---|---|---|---|---|---|
| Characteristics | Units | Invention | Sp1 | Sp2 | Sp3 |
| Grammage | $g/m^2$ | 37.4 | 67 | 84 | 56 |
| Thickness | microns | 160 | 124 | 160 | 89 |
| Body | $cm^3/g$ | 4.28 | 1.85 | 1.9 | 1.59 |
| Permeability | $1/m^2/s$ under 196 Pa | 644 | 112 | 822 | 305 |
| Tensile strength, machine direction | N/m | 2905 | 3726 | 2898 | 1762 |
| Tensile strength, cross direction | N/m | 1646 | 1792 | 728 | 736 |
| Elongation, machine direction | % | 2.1 | 1.8 | 1.3 | 0.9 |
| Elongation, cross direction | % | 6.0 | 2.2 | 0.9 | 1.4 |
| Tear strength, machine direction | Cn | 168 | 198 | 185 | 100 |
| Tear strength, cross direction | Cn | 240 | 332 | 210 | 129 |
| Mean pore diameter | microns | 100 | several millimeters | | |

Such a paper is also perfectly suited to serving as support element for a stack of fabrics on a manufacturing line.

Compared with the prior perforated papers used as supports for stacks of fabrics on a manufacturing line, the proposed paper sheet has many advantages, among which mention may be made of:

- since the distribution of the pores within the structure is uniform, the risk of dust being taken up into the textile during the cutting operation is virtually zero;
- in addition, the uniformity of the sheet ensures that it slides better over the cutting surface, without soiling the latter;
- since such a sheet is perfectly plane, this virtually eliminates any risk of marking the surface of the textiles, particularly in the case of fine textiles;
- because of its uniformity, such a sheet ensures that the thickness of the mat is more homogeneous, which consequently means better cutting of the textile;
- the uniformity of the sheet also ensures an overall smaller thickness because of the absence of bumps and hollows, thereby making it possible to envisage increasing the number of textile layers in the mat; and finally and above all, it is possible to use such a support whatever the type of fabric forming part of the stack, whereas, previously, it was necessary to use ranges of perforated paper having different characteristics.

Of course, the invention is not limited to the illustrative examples described above, rather it encompasses all variants thereof which are produced within the same context.

What is claimed is:

1. A method for supporting a stack of fabrics on a manufacturing line, said method comprising placing the stack of fabrics on an air-permeable paper sheet having pores distributed over a surface thereof, and a bulk greater than or equal to 3.53 cubic centimeters per gram.

2. A method according to claim 1, wherein the pores are uniformly,distributed over the surface of the sheet, and have a diameter of less than one millimeter.

3. A method according to claim 1, wherein the pores are distributed in the form of patterns having a central region with high air permeability surrounded by a denser fibrous region with lower permeability.

4. A method according to claim 3, wherein the pores are produced during production of the sheet, before drying thereof, by a treatment comprising locally displacing fibres by means of fluid jets or knives through a mesh having a coarse texture or through a perforated cylinder.

5. A method according to claim 3, wherein spacing between centres of two consecutive patterns is less than 5 mm, the central region containing no fibres and having a total area of about 1 to 2 $mm^2$.

6. A method according to claim 1, wherein the sheet is produced directly on a paper machine without any special modification, and cellulose fibres are individualized without refining them excessively during preparation of a cellulose pulp; the cellulose pulp is fed to the machine at a concentration of less than one gram per liter to obtain a bulking sheet; and the sheet is not compressed at the wet end of the machine.

7. A method according to claim 6, wherein synthetic, artificial or natural fibres are incorporated into the cellulose pulp.

8. A method according to claim 7, wherein the fibres are incorporated in an amount of 5 to 25% by weight.

9. A method according to claim 6, wherein an additional binder is incorporated into the sheet during its manufacture.

10. A method according to claim 1, wherein the pores are uniformly distributed over the surface of the sheet, and have a diameter ranging between 50 and 150 microns.

11. A method according to claim 3, wherein spacing between the centres of two consecutive patterns is less than 3 mm, the central region containing no fibres and having a total area of about 1 to 2 $mm^2$.

* * * * *